US008950856B2

(12) United States Patent
Aihara

(10) Patent No.: US 8,950,856 B2
(45) Date of Patent: Feb. 10, 2015

(54) TRANSFER DEVICE

(71) Applicant: Yuichi Aihara, Yamanashi-ken (JP)

(72) Inventor: Yuichi Aihara, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 15 days.

(21) Appl. No.: 13/954,270

(22) Filed: Jul. 30, 2013

(65) Prior Publication Data

US 2014/0036015 A1 Feb. 6, 2014

(30) Foreign Application Priority Data

Jul. 31, 2012 (JP) ..... 2012-170338

(51) Int. Cl.
*B41J 2/01* (2006.01)
*B41M 5/025* (2006.01)
*B41F 16/00* (2006.01)

(52) U.S. Cl.
CPC ..... *B41M 5/025* (2013.01); *B41F 16/0026* (2013.01); *B41F 16/006* (2013.01); *B41P 2219/21* (2013.01); *B41P 2219/22* (2013.01); *B41P 2219/23* (2013.01); *B41P 2219/43* (2013.01)
USPC ..... 347/103; 347/104; 347/217; 347/215

(58) Field of Classification Search
USPC ..... 347/103, 104, 215, 217
See application file for complete search history.

(56) References Cited

U.S. PATENT DOCUMENTS 8,363,076 B2 1/2013 Aihara et al.

*Primary Examiner* — Henok Legesse
(74) *Attorney, Agent, or Firm* — Manabu Kanesaka

(57) ABSTRACT

A transfer device is provided to realize a higher speed in terms of print time by reducing a conveyance time of an ink ribbon to a beginning position of each ink panel. The transfer device includes an image formation unit conveying the ink ribbon and a recording medium held between a thermal head and a platen, and transferring a transfer image onto the recording medium; a ink ribbon conveyance device for conveying the ink ribbon; a recording medium conveyance device for conveying the recording medium; and a control device for controlling the ink ribbon conveyance device and the recording medium conveyance device to control, in the image formation unit, beginning positions of a transfer start position of the ink panel and a transfer start position of the recording medium.

6 Claims, 12 Drawing Sheets

TRANSFER DEVICE

BACKGROUND OF THE INVENTION

The present invention relates to a device that transfers and prints characters and color images onto card-like recording media such as ID cards, identification papers, and various membership cards, and particularly to a technique for increasing a transfer and print speed at which each ink of an ink panel, on which a plurality of types of ink colors are continuously formed in a frame sequential manner at almost equal intervals to the width of a recording medium, is indirectly transferred to the card-like recording medium via an intermediate transfer film, or a transfer and print speed at which an ink of an ink panel is directly transferred to the card-like recording medium.

Conventionally, what is known as a print device for card-like recording media is a device that prints image data, such as photographs of faces, onto a cardboard card-like recording medium that is made of plastics or waterproofed, for example. Examples of card-like recording media include driver license, various membership cards, employee ID cards of individuals who own the cards, and other ID cards. Photographs of faces and personal information are printed on the cards. However, information whose data size is large is not printed onto a large number of cards.

In recent years, as on-demand printing, the following printer system has been known: the printer system is incorporated into a computer network, and is designed to simultaneously carry out recording of electronic data, which include to-be-displayed data, such as photographs of individuals who own cards, issuer, and types of cards, and personal information, and is connected to a network. A printer that is used for such a printer system is a sublimation-type transfer device The sublimation-type transfer device is designed to use an ink ribbon on which a plurality of types of ink panel planes having a predetermined width corresponding to a printing width of a card are disposed in a frame sequential manner in order to transfer and print transfer images, such as characters and images, onto cards. In order to transfer and print data onto cards, a direct method and an intermediate transfer method are available: According to the direct method, data are directly printed onto cards; according to the intermediate transfer method, data are primarily transferred onto a transfer film, from which the data are then secondarily transferred onto cards. However, both the methods are the same in that, across a surface of a card or film onto which data is transferred, printing is carried out as ink panels to which colors of ink ribbons, such as yellow, magenta, cyan, and black, are applied pass thorough in such a way as to sequentially overlap.

At this time, in order for the ink panel planes to sequentially and precisely overlap with respect to a printing width of a surface of a recording medium, such as a card or a film, to which data is transferred, a transfer start position of each ink panel and a transfer start position of a recording medium need to be accurately aligned with each other at beginning positions. Conventionally, in order to carry out a cue control operation, with respect to the center of each ink panel of an ink ribbon, a process of searching for the beginning of each ink panel is carried out in such a way as to be aligned with the center of image data that is to be printed (See Patent Document 1, for example).

CITATION LIST

Patent Document

[Patent Document 1] Japanese Patent Application Laid-Open Publication No. 2011-51142

SUMMARY OF THE INVENTION

If such a conventional cue control operation is used to print an image G1 across the entire surface of a recording medium, as shown in FIG. 10A, a conveyance time A of an ink ribbon between ink panels is less than a conveyance time B during which a recording medium goes back to a transfer start position after printing by one ink panel is finished (A<B); the conveyance time A of the ink ribbon does not affect an entire print time.

However, if a transfer image G2 is smaller than a predetermined printing width as shown in FIG. 10B, the conveyance time A of an ink ribbon between ink panels is greater than the time B during which a recording medium travels a distance equal to the printing width thereof back to a transfer start position after printing by one ink panel is finished (A>B); the difference affects the entire print time. That is, even after the recording medium is conveyed to the beginning position, a process of conveying to a beginning position of the next ink panel is not completed on the ink ribbon. Therefore, the recording medium needs to wait during the time. The waiting time makes the entire print time longer.

The present invention has been made in view of the above-described problems of the prior art. The object of the present invention is to provide a transfer device that becomes faster in terms of print time by reducing a time during which each ink panel of an ink ribbon is conveyed to a beginning position.

In order to achieve the above object, according to the present invention, a transfer device, which uses an ink ribbon on which a plurality of types of ink panel planes of a predetermined width corresponding to a printing width of a recording medium are disposed in a frame sequential manner to transfer and print a transfer image, such as a character and an image, onto the recording medium, includes: an image formation unit that conveys the ink ribbon and recording medium being held between a thermal head and a platen, and transfers the transfer image onto the recording medium; ink ribbon conveyance means for conveying the ink ribbon; recording medium conveyance means for conveying the recording medium; and control means for controlling the ink ribbon conveyance means and the recording medium conveyance means to control, in the image formation unit, beginning positions of a transfer start position of the ink panel and a transfer start position of the recording medium, in which, in controlling the beginning positions, the control means sets a transfer start position of a first ink panel in such a way that a center position in an ink ribbon conveyance direction of the transfer image transferred by the first ink panel that is located in a first section of the ink ribbon is put at a position which enables the entire transfer image to be placed within the first ink panel plane and which is closer to a next ink panel's side than a center of the first ink panel.

The control means sets a transfer start position of a last ink panel of the ink ribbon in such a way that a center position in an ink ribbon conveyance direction of the transfer image transferred by the last ink panel that is located in a last section of the ink ribbon is put at a position which is closer to a previous ink panel's side than a center position of the last ink panel.

The control means sets one or a plurality of transfer start positions of a transfer image in another intermediate ink panel disposed between the first ink panel and the last ink panel in such a way that the transfer start positions are set at regular intervals between a transfer end position of the first ink panel and a transfer start position of the last ink panel.

If a distance from a transfer end position of the transfer image on the first ink panel to a transfer start position of the last ink panel is represented by A, the number of the intermediate ink panels by N (including 1), a total distance associated with a data size of a transfer image in the ink ribbon conveyance direction of transfer data transferred by the intermediate ink panel by B, and a distance from a transfer end position of a previous ink panel to a transfer start position of a next ink panel by C, the control means sets a transfer start position of the intermediate ink panel on the basis of C that is calculated by: $C=(A-B)/(N+1)$.

The control means at first sets a transfer end position of the first ink panel to the same position as a transfer end position used for an entire surface transfer process in which a transfer process is carried out across an entire surface of the recording medium, and then sets a transfer start position of the first ink panel in accordance with a data size of a transfer image.

The control means sets a transfer start position of the last ink panel to the same position as a transfer start position used for an entire surface transfer process in which a transfer process is carried out across an entire surface of the recording medium.

In the transfer device of the present invention, when a transfer process is performed, the transfer start position of the first ink panel of the ink ribbon is shifted toward an ink panel rear side relative to a conventional central reference position. Therefore, the ink-ribbon cue distance to the next ink panel is reduced, thereby reducing the time required for bringing the ink ribbon to a beginning position and increasing a print speed.

DETAILED DESCRIPTION

Figure 1:
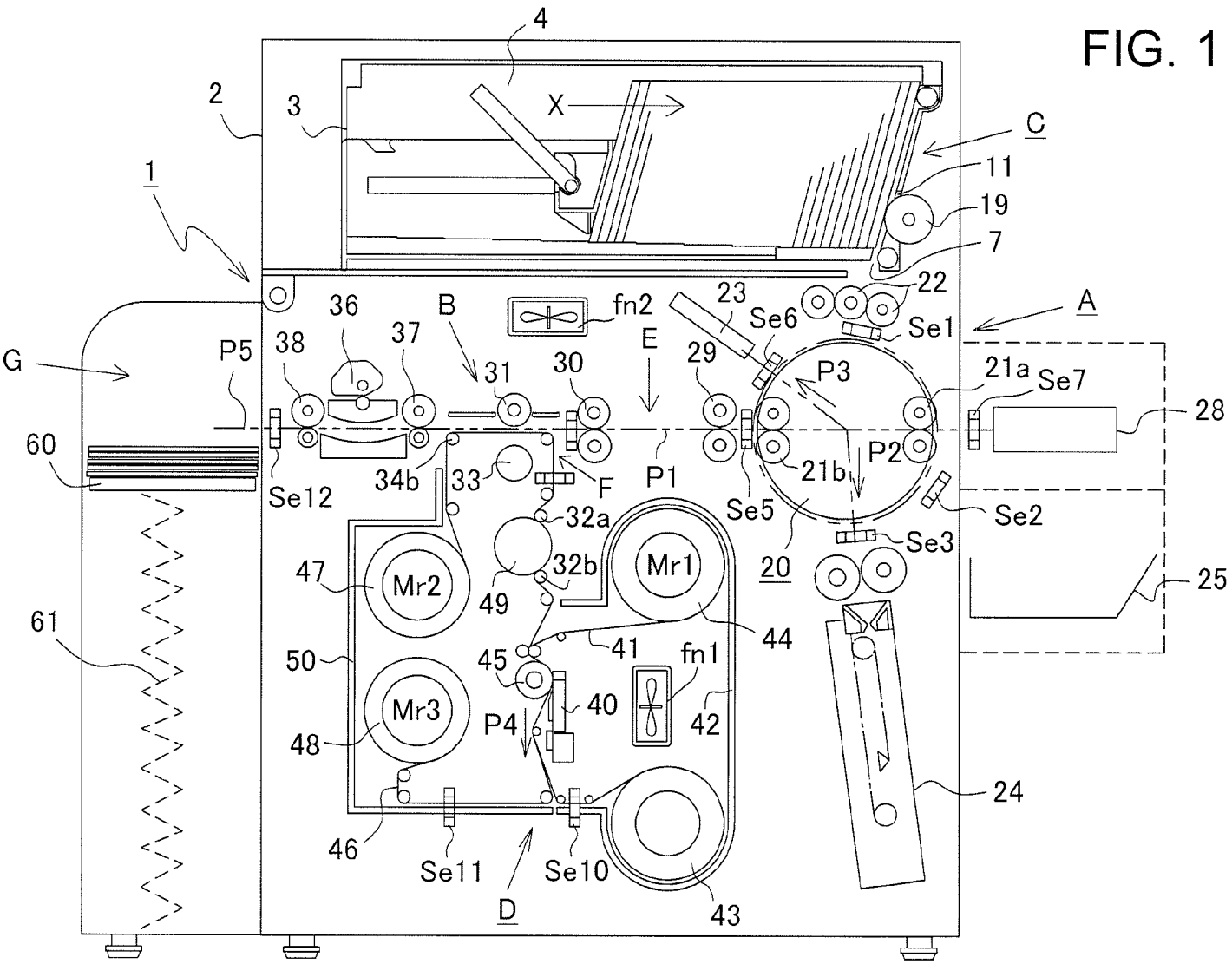
FIG. 1 is an explanatory diagram showing an overall configuration of a transfer device according to the present invention.

Hereinafter, on the basis of a preferred embodiment shown in the accompanying drawings, the present invention will be detailed. FIG. 1 shows an overall configuration of a transfer device 1 according to the present invention, explaining the case where the device is of an intermediate transfer type. For example, the transfer device 1 is designed to carry out "recording of information," such as magnetic information and IC information, and "forming (printing) of images," such as characters, photographs, and marks, to ID cards for various kinds of authentication, credit cards for commercial transactions, and the like.

The transfer device 1 includes a device housing 2, an information recording unit A, an image transfer unit B, a media supply unit C, and an image formation unit D. On an intermediate transfer film 46, an image is formed by the image formation unit D; the image is transferred onto a recording medium, which is fed from the media supply unit C. In a process that comes before the transferring of the image, information, such as magnetic information and IC information, is recorded on the recording medium.

A card that includes a built-in IC chip to record IC information has an uneven surface; an intermediate transfer-type print method is suitable for the card. Even when an image is transferred onto a card whose surface is coated with a hologram or the like, the intermediate transfer-type print method is effective.

Each component will be described with reference to FIG. 1. In the device housing 2, the media supply unit C and a reversing unit 20 are disposed: the reversing unit 20 changes a direction of a recording medium (referred to as a "card," hereinafter) that is fed from the media supply unit C. On a downstream side of the reversing unit 20, a first conveyance path P1, along which the card is conveyed in a first direction, and a second conveyance path P2, along which the card is conveyed in a second direction, are disposed. From the reversing unit 20, separately from the second conveyance path P2, a third conveyance path P3, along which the card is conveyed in a third direction, is disposed.

The media supply unit C includes a paper feed cassette 3 in which a plurality of cards are aligned and stored in a front-back direction in a standing posture; a direction in which cards are fed (or a direction indicated by arrow X in FIG. 1), and a card conveyance direction of the first conveyance path P1 are so disposed as to be opposite to each other and be substantially parallel to each other. As shown in FIG. 1, the paper feed cassette 3 includes a box-shaped cassette housing and a card storage unit 4, which is provided in the housing. The card storage unit 4 includes a storage space that fits the size of cards, allowing a plurality of cards to be aligned and stored in a standing posture.

The first card in a row that is stored in the card storage unit 4 is fed out of a paper feed opening 7 as a pick-up roller 19, which protrudes into the card storage unit 4 through a picker opening 11, is rotated.

The above reversing unit 20 is provided below the media supply unit C so as to be adjacent thereto. The reversing unit 20 is placed at a one end side (or the right side in FIG. 1) of the device housing 2. On the downstream of the reversing unit 20, the first conveyance path P1 is disposed in almost a horizontal direction, and the second conveyance path P2 is disposed in almost a vertical direction. The first and second conveyance paths P1 and P2 are disposed in different angular directions; as shown in the diagram, it is preferred that the first and second conveyance paths P1 and P2 be disposed within an angular range of 90 to 180 degrees. However, depending on the degree of confluence of paths, an appropriate angular range is set.

As for the reversing unit 20, carrying rollers 22 are disposed at a downstream side of the paper feed opening 7 of the paper feed cassette 3. A card that is fed out from the paper feed cassette 3 is conveyed by the carrying rollers 22 into the reversing unit 20. The reversing unit 20 includes a unit frame, which is supported by bearings so as to be able to pivot at a device frame (not shown); and a pair of rollers, or a plurality of pairs of rollers, which are supported on the frame.

In the case of what is shown in the diagram, two pairs of rollers 21*a* and 21*b*, which are so disposed as to be spaced out in the front-back direction, are supported by shafts on the unit frame in such a way as to be able to freely rotate. The unit frame is pivoted in a predetermined angular direction by a swing motor that is made up of a pulse motor or the like. The pairs of rollers 21*a* and 21*b*, which are attached to the unit frame, are so formed as to rotate in forward and reverse directions by a conveyance motor. A drive mechanism thereof is not shown in the diagram; the drive mechanism, however, is so formed as to use, for example, one pulse motor performs the pivoting of the unit frame and the rotation of the pairs of rollers by using a clutch.

In that manner, the cards that are prepared in the paper feed cassette 3 are fed out by the pick-up roller 19, and the cards are separated by a separation gap of the paper feed opening 7, and one card after another is sent to the downstream-side reversing unit 20. The reversing unit 20 uses the pairs of rollers 21*a* and 21*b* to convey the card into the unit, and deflects the posture thereof toward a predetermined angular direction when the card is being nipped by the pairs of rollers.

The reversing unit 20 is disposed at a connection point of the first conveyance path P1, second conveyance path P2, and third conveyance path P3. The reversing unit 20 is so disposed as to rotate by predetermined angles toward each of the path directions. On the second conveyance path P2, a magnetic recording unit 24 is disposed. The magnetic recording unit 24 records magnetic information on a magnetic stripe of a card that is sent from the reversing unit 20. The magnetic recording unit 24 shown in the diagram includes a read/write head, which allows the magnetic recording unit 24 to read the recorded information and make a determination as to whether or not the information is correct at the same time when the magnetic information is recorded.

On the third conveyance path P3, a non-contact type IC recording unit 23 is disposed to record information on a built-in IC of a card. On a pivoting-direction outer periphery of the reversing unit 20, a reject stacker 25 and a bar-code reader 28 are disposed. The bar-code reader 28 is provided to make a determination, when a bar code is printed by the image transfer unit B (described later), as to whether or not the printing results are appropriate (or to make an error determination) after reading the bar code.

Accordingly, after the reversing unit 20 uses the pairs of rollers 21*a* and 21*b* to convey the card whose posture is deflected toward a predetermined angular direction to the recording unit 24 (or 23), it becomes possible to magnetically or electrically input data onto the card. If a recording error occurs in the data input units, the card is ejected into the reject stacker 25.

The first conveyance path P1 is disposed on an upstream side of the image transfer unit B; a first pair of rollers 29 and a second pair of rollers 30, which are connected to a conveyance motor (not shown), are used as conveyance means. The first and second pairs of rollers 29 and 30 are so formed as to be able to switch between forward and reverse rotations, allowing a card to be conveyed from the reversing unit 20 to the image transfer unit B, and from the image transfer unit B to the reversing unit 20 at the same time. Incidentally, a conveyance mechanism by the first and second pairs of rollers 29 and 30 may be a belt.

On the first conveyance path P1, a media waiting section E and the image transfer unit B are disposed. The media waiting section E is provided between the reversing unit 20 and the image transfer unit B. The image transfer unit B includes a transfer platen (i.e. platen roller as shown in the diagram) 31 and a heating roller 33; between the transfer platen 31 and the heating roller 33, a card and a transfer film 46 pass. The heating roller 33 is moved upwards and downwards by a lifting mechanism (not shown) between a position where the heating roller 33 is pressed against the transfer platen 31 and a separated position. Accordingly, between the heating roller 33 and the transfer platen 31, a recording card and a transfer film 46 are simultaneously pressurized and heated. As a result, an image ink that is formed on the transfer film 46 is heated and deposited on the recording card, and an image is transferred onto a surface (or lower surface in the case of FIG. 2) of the card.

Figure 2:
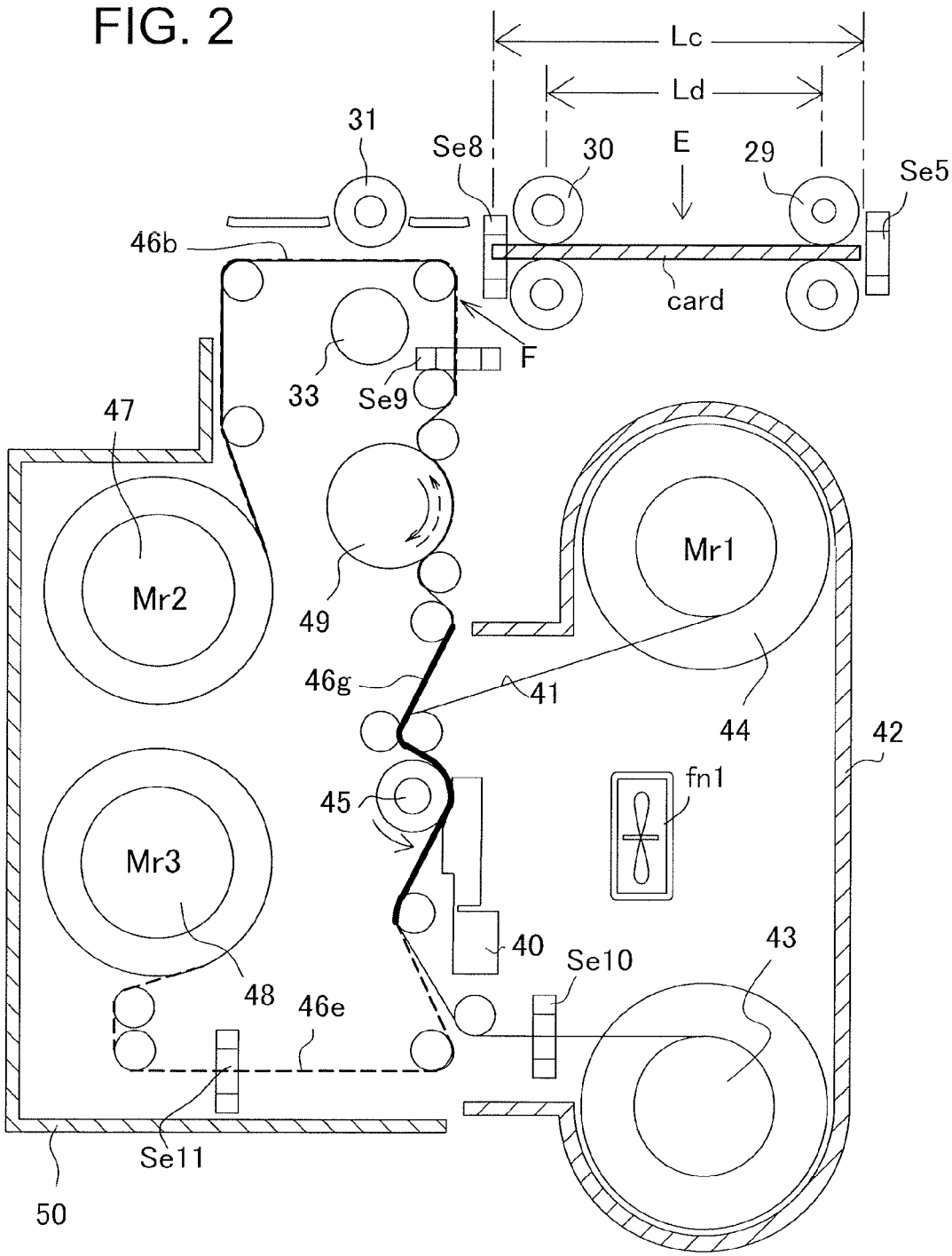
FIG. 2 is an explanatory diagram showing a situation where a transfer film in the device of FIG. 1 is fed to an image formation unit, and an image is formed.

On the first conveyance path P1, the media waiting section E is disposed on an upstream side of the image transfer unit B. In the media waiting section E, as shown in FIG. 2, the first pair of rollers 29 and the second pair of rollers 30 are so disposed that a distance Ld between the first and second pairs of rollers 29 and 30 is shorter than a conveyance-direction length Lc of a card. While being held by the first and second pairs of rollers 29 and 30, which are spaced out in the front-back direction, the card temporarily waits. Between the first and second pairs of rollers 29 and 30 and a drive motor, a transmission clutch (not shown) is provided; when the clutch is turned OFF, the card is stopped to wait. The first and second pairs of rollers 29 and 30 are disposed between the reversing unit 20 and the image transfer unit B.

On the second pair of rollers 30 that is closer to the transfer platen 31, a sensor Se8 is disposed to detect the tip of a card; the sensor Se8 detects whether or not the card exists in the media waiting section E. At this time when the card is waiting, the tip of the card is closer to the upstream side than the heating roller 33. Therefore, the tip portion of the waiting card is not heated by the heating roller 33, thereby eliminating the possibility that an image transferred onto the card could become uneven.

The media waiting section E is disposed on the first conveyance path P1 between the reversing unit 20 and the image transfer unit B. Therefore, it is possible to separately control a job of recording magnetic information at the second conveyance path P2 that is located on the upstream side, and a job of recording IC information at the third conveyance path P3, and a job of forming an image at the first conveyance path P1 that is located on the downstream side.

The transfer film 46 is used for transferring (or secondarily transferring) an image onto a card. A process of transferring (primarily transferring) the image onto the transfer film 46 is carried out in the image formation unit D.

The image formation unit D is designed to use an ink ribbon 41 to transfer and print a transfer image, such as characters and images, onto the transfer film 46, which is a recording medium. The image formation unit D includes an image formation platen 45, and a thermal head 40, which is so disposed as to face the platen. On a film transport path P4 between the image formation platen 45 and the thermal head 40, a sublimation-type ink ribbon 41, which is supplied from a ribbon cassette 42, and the transfer film 46 travel.

The transfer film 46 is wound around a supply spool 47 and take-up spool 48 of a film cassette 50. Between the supply spool 47 and the take-up spool 48, the above film transport path P4 is formed. The supply spool 47 is connected to a feeding motor Mr2, and the take-up spool 48 to a take-up motor Mr3. Both motors are attached to the device frame, and are connected to a spool shaft via a coupling means. Both motors are stepping motors, and rotate in the same direction so as to have the same feed amount.

On the film transport path P4, a transport roller 49 and pinch rollers 32*a* and 32*b* are disposed. The transfer film 46 is conveyed on the film transport path P4 as the transport roller 49 is pressed against the pinch rollers 32*a* and 32*b*. Accordingly, the transport roller 49 and the pinch rollers 32*a* and 32*b* constitute conveyance means of the transfer film 46. The transport roller 49 is connected to a drive motor, and is designed to enable the transfer film 46 to travel at a constant speed. At this time, a sensor Se9 detects markers that are formed on the transfer film 46 at predetermined intervals. The transport roller 49 is so configured that, when an image is formed on the transfer film 46, the ink ribbon 41 and the transfer film 46 rotate in a counterclockwise direction (or a direction indicated by dotted arrow), as shown in FIG. 2, at the same speed.

The ink ribbon 41 is stored in the ribbon cassette 42. In the ribbon cassette 42, a supply spool 43 and a take-up spool 44, which constitute an ink ribbon conveyance means, are incorporated so as to be able to rotate. The take-up spool 44 is connected to a winding motor Mr1. Between the two spools 43 and 44, a film-like ink ribbon 41 is wound. The ink ribbon 41 is a sublimation-type ribbon; ink panel planes of Y (yellow), M (magenta), C (cyan), and B (black) are placed like a belt in a frame sequential manner. Each ink panel plane has a predetermined width corresponding to a printing width of the transfer film 46. A sensor Se10 detects the position of the ink ribbon 41, which is conveyed as the take-up spool 44 is driven.

The ribbon cassette 42 is mounted on the device housing 2 in such a way that the ribbon cassette 42 can be attached to and detached from the device housing 2 in a front-back direction of the paper of FIG. 1. The ink ribbon 41 is inserted into between the image formation platen (platen roller) 45 and thermal head 40, which are provided on the device housing 2.

The transfer film 46 is take out from the supply spool 47, and is rotated in a clockwise direction of the transport roller 49; the transfer film 46 is therefore conveyed to a beginning position for image transfer. At this time, the ink ribbon 41, too, is conveyed to the beginning position as the take-up spool 44 is rotated in a counterclockwise direction. In this manner, during the above operation, the conveyance directions of the transfer film 46 and ink ribbon 41 are opposite.

After the transfer film 46 and the ink ribbon 41 are aligned with each other at the beginning position, the image formation platen 45 is moved by an extrusion mechanism (not shown) toward the thermal head 40, and comes in contact with the thermal head 40 in such a way that the transfer film 46 and the ink ribbon 41 are sandwiched therebetween.

To the thermal head 40, a head control IC 74*x* (see FIG. 3) is connected, and is designed to control heating of the thermal head 40. The head control IC 74*x* controls the heating of the thermal head 40 in accordance with image data that is transmitted, along with printing instructions, from a higher-level device such as a host computer. Incidentally, a cooling fan fn1 is provided to cool the thermal head 40.

Therefore, in synchronization with the heating control process of the thermal head 40, the take-up spool 44 is rotated, and the ink ribbon 41 is moved at a predetermined speed in a take-up direction. At this time, the transport roller 49 is rotated in a counterclockwise direction, and the transfer film 46 moves a distance equivalent to a printing width of one card in the same direction as the ink ribbon 41. As a result, an image is formed in the section.

After a process by one ink panel of transferring an image is finished, the transport roller 49 is rotated again in a clockwise direction, thereby bringing the transfer film 46 back to the beginning position as the transfer film 46 moves a distance equivalent to a printing width of one card. At this time, the ink ribbon 41 continues to move in the take-up direction. Therefore, the next ink panel is aligned with the transfer film 46 at the beginning position.

In such a cue control process, each of the ink panels of Y (yellow), M (magenta), C (cyan), and B (black) is sequentially aligned with the transfer film 46 at the beginning position. After the alignment process, a process of heating and transferring with the use of the thermal head 40 and the image formation platen 45 is repeated. As a result, an image, such as a photograph of a face or character data, which will be printed on front and back surfaces of a card, is transferred onto the transfer film 46.

According to the present invention, in order to shorten a total time required to convey the ink ribbon 41 to the beginning, an optimization control process for an ink ribbon usage position is carried out in such a way that, for each ink panel, the beginning position is appropriately set. The optimization control process will be described in detail later.

On a downstream side of the image transfer unit B, an unloading path P5 is provided to convey a recording card to a storage stacker 60. On the unloading path P5, conveyance rollers 37 and 38 are provided to convey a recording card. The conveyance rollers 37 and 38 are connected to a conveyance motor (not shown). Incidentally, between the conveyance rollers 37 and 38, a decal roller 36 is disposed; the decal roller 36 presses a central portion of a card held between the conveyance rollers 37 and 38, thereby correcting a curl thereof.

As shown in FIG. 1, a storage section G is so formed as to store, in the storage stacker 60, a card that is sent from the image transfer unit B. The storage stacker 60 is so formed as to use a lifting mechanism 61 and a level sensor (not shown) to detect the topmost card, and move downwards toward a lower side of FIG. 1 using the lifting mechanism 61.

On the film transport path P4, on an upstream side of the image transfer unit B, a film waiting section F is provided. The waiting section F is so formed that the transfer film 46 can be temporarily stopped to wait. The film waiting section F and the above media waiting section E are disposed at the same distance from the downstream-side image transfer unit B. Therefore, the recording card and the transfer film 46, which are waiting in both the waiting sections in such a way that the tips are aligned, can be fed out at the same timing to the image transfer unit B.

As shown in FIG. 1, the film cassette 50 is a separate unit from the device housing 2. The film cassette 50 is mounted on the device housing 2 in such a way that the film cassette 50 can be attached to and detached from the device housing 2. Although not shown in the diagram, when a front cover, which is provided on a front side of FIG. 1 so as to be freely opened and closed, is being opened, the film cassette 50 can be mounted on the device frame. Incidentally, a fan fn2 is provided in the image transfer unit B to release generated heat out of the device.

Figure 3:
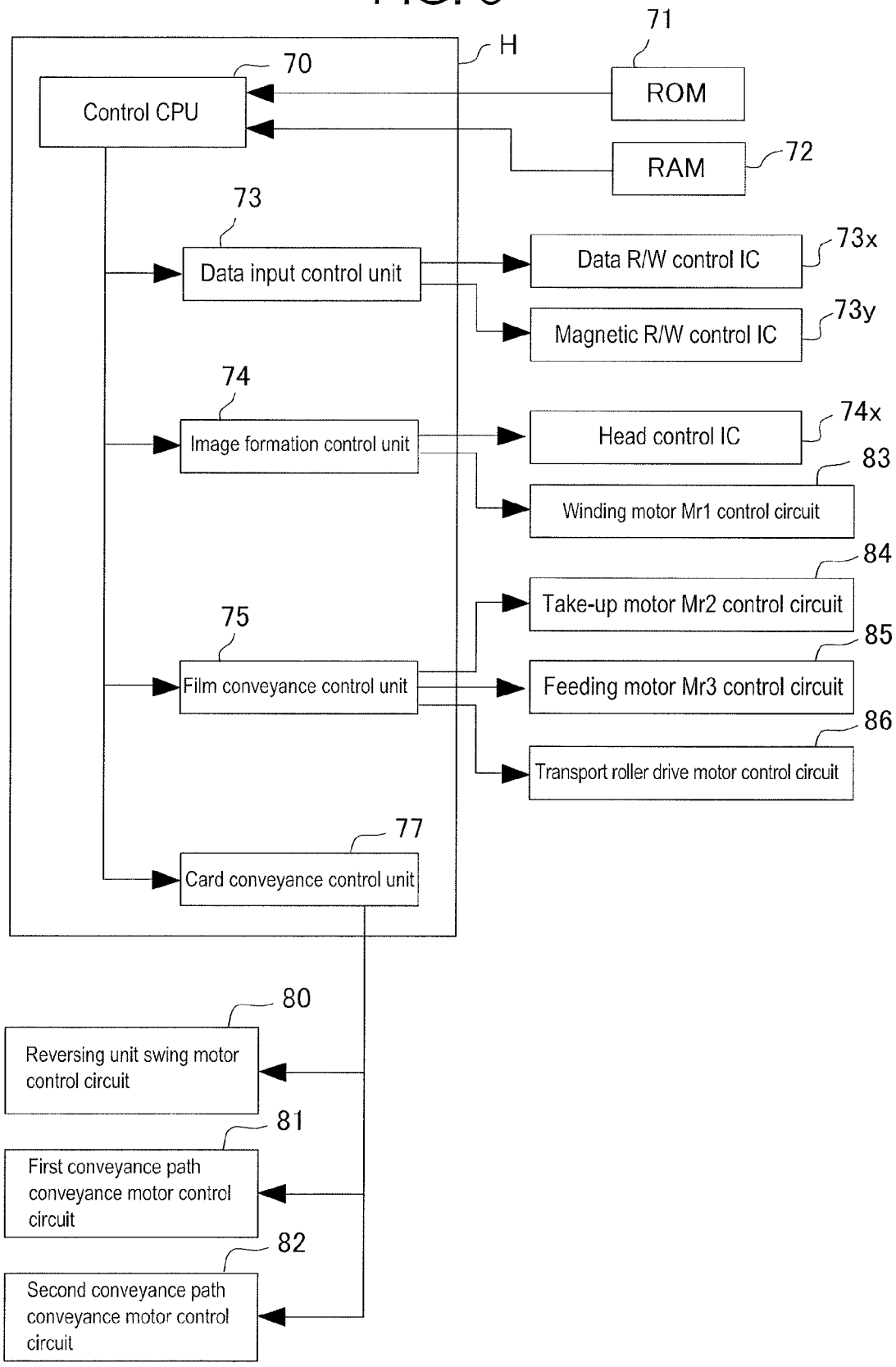
FIG. 3 is a block diagram showing a control configuration of the device of FIG. 1.

A configuration that is used to control the transfer device 1 having the above configuration will be described with reference to FIG. 3. A control section H (control means) includes a control CPU 70, for example. The control CPU 70 is equipped with a ROM 71 and a RAM 72. FIG. 3 is a block diagram illustrating the control CPU 70 that executes a control program stored in the ROM 71, thereby functioning as a data input control unit 73, an image formation control unit 74, a film conveyance control unit 75, and a card conveyance control unit 77 to carry out control operations.

The card conveyance control unit 77 detects the position of a card that is conveyed by using each sensor disposed on a conveyance path along which a card taken out from the media supply unit C is conveyed to a storage unit 6. In response, the card conveyance control unit 77 supplies a control signal to a reversing unit swing motor control circuit 80, a first conveyance path conveyance motor control circuit 81, and a second conveyance path conveyance motor control circuit 82. In this manner, the card conveyance control unit 77 controls a process of conveying a card.

The data input control unit 73 transmits, to a built-in data R/W IC 73*y* of a magnetic recording unit, a command signal to control a process of transmitting and receiving input data. Similarly, the data input control unit 73 transmits a command signal to a data R/W IC 73*x* of an IC recording unit.

The image formation control unit 74 is designed to control the thermal head 40, which forms an image on the transfer film 46 in the image transfer unit B by using the ink ribbon 41, and at the same time to control a process of conveying the ink ribbon 41 by outputting a control signal to a winding motor Mr1 control circuit 83. The film conveyance control unit 75 outputs a control signal to a take-up motor Mr2 control circuit 84, a feeding motor Mr3 control circuit 85, and a transport roller drive motor control circuit 86 to control a process of conveying the transfer film 46.

After magnetic/IC information and image information, which will be recorded on a card, are transmitted from a higher-level device such as a host computer, the control unit H records information on the card in response to the data in the following manner: a "combination of magnetic information and image information," or a "combination of IC information and image information," or a "combination of magnetic and IC information and image information," or any other combination.

An operation of the above transfer device 1 under the control of the control unit H will be described with reference to a flowchart of FIG. 4.

The control unit H receives a job start signal (StA1), and then feeds a card from the media supply unit C into the device (StA2). An entrance sensor Se1 detects the tip of the card that is supplied into the device (StA3). After the entrance sensor Set detects the card that is conveyed, a control means controls the reversing unit 20 to convey the card to a conveyance path (i.e. the first, second, or third conveyance path) that is specified by an external device (StA4).

At the same time when the card is conveyed to the recording unit, the control unit H feeds the transfer film 46 to the image formation unit D (StA5). The process of feeding the film is carried out as the feeding motor Mr2 and the take-up motor Mr3 are rotated and controlled. A film sensor Se9 is used to detect the amount of feeding. On the transfer film 46, a mark is formed for each frame having a predetermined width corresponding to a printing width of a region of the card where an image is formed. The mark is detected by the sensor Se9 to control the amount of feeding of the film (see FIG. 2).

Then, the control unit H performs a process (StA6) of transferring data of magnetic/IC information, and a process (StA7) of transferring data of image information. The data transfer processes may be carried out at different times depending on data volume, and the status of a transfer means; other subsequent operations, which run parallel, may come first.

After the magnetic/IC information is acquired, and the card is conveyed to the recording unit, the control unit H records the magnetic/IC information on the card (StA8). The process of recording the magnetic/IC information is carried out by a magnetic R/W unit 24 and an IC R/W unit 23. If an error is detected from the recorded information, the card is conveyed to an eject stacker 25. If a reading/writing error occurs on the card, the control unit H then feeds the next card (or a blank card) from the media supply unit C.

Then, the control unit H sets the temperature of a head of the thermal head 40 to an appropriate value (StA9). During the process of setting the temperature, if the temperature of the head is excessively high, the temperature is decreased; if the temperature of the head is low, the temperature is raised. However, if the temperature has risen excessively, it takes time to cool. Therefore, the control unit H makes the transfer film 46 wait until the head temperature is set to an appropriate value. Then, the control unit H waits for the head temperature to be set to an appropriate value before carrying out a process of forming an image (StA11).

During the process of forming the image, the control unit H controls a process of driving the feeding motor Mr2 to take out the transfer film 46 from the supply spool 47; the control unit H also controls a process of rotating the transport roller 49 in a clockwise direction (or a direction indicated by solid arrow), thereby moving the transfer film 46 to an image-transfer beginning position. At this time, the control unit H controls a process of driving the winding motor Mr1 to rotate the take-up spool 44 in a counterclockwise direction, thereby moving the ink ribbon 41, too, to the beginning position. As a result, a transfer start position of the transfer film 46 is aligned with a transfer start position of the ink ribbon 41 at the beginning position.

Figure 5:
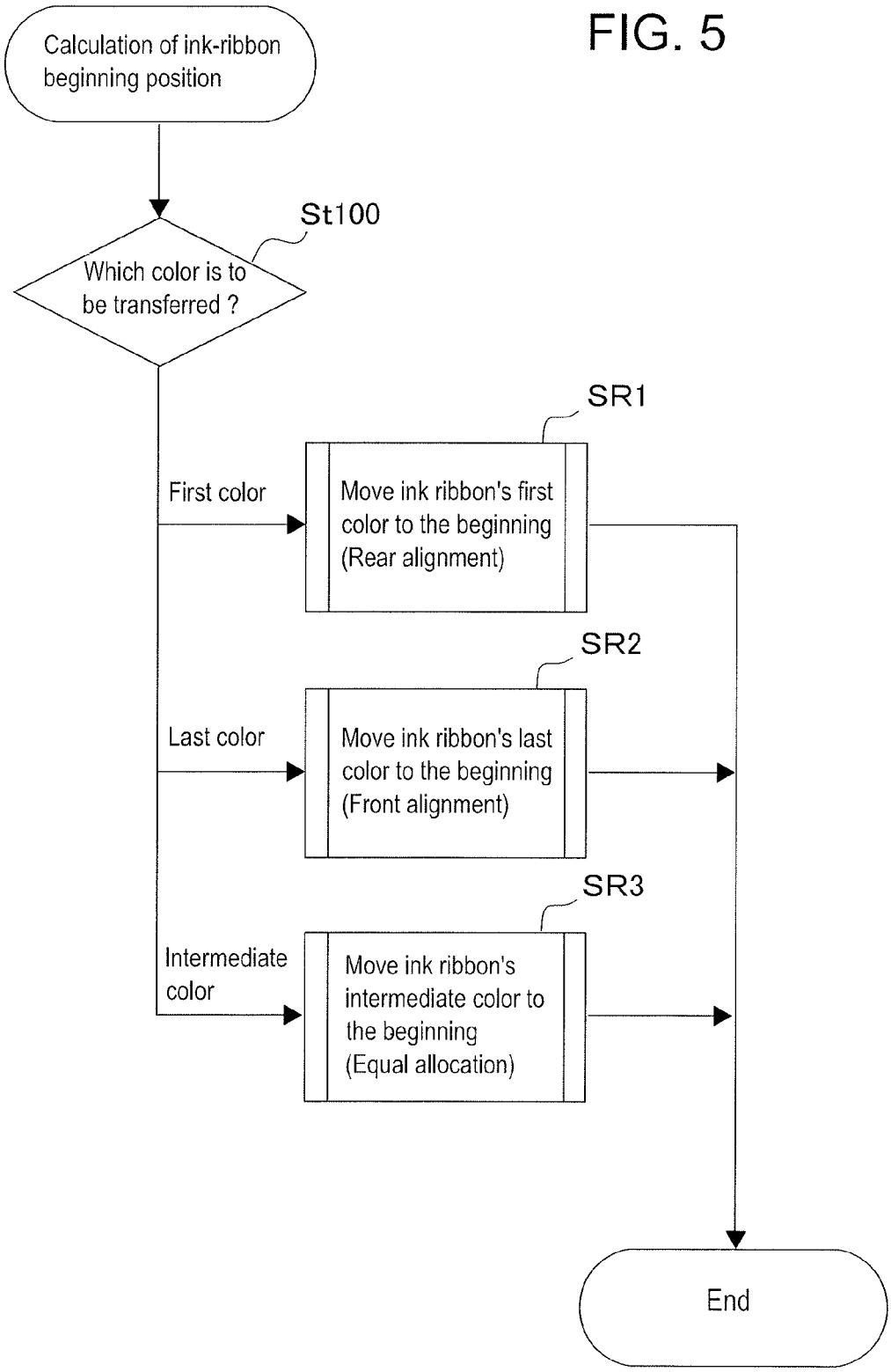
FIG. 5 is a flowchart illustrating an optimization control operation by the control unit H of an ink ribbon usage position.

The following describes the above-mentioned optimization control process for an ink ribbon usage position, which is performed to shorten a total time required to convey the ink ribbon 41 to the beginning position. FIG. 5 shows a flowchart of the optimization control process by the control unit H.

The optimization control process for an ink ribbon usage position starts with a process of making a determination (St100) as to which color is to be transferred to a transfer surface of the transfer film 46.

In the present example, four colors, yellow, magenta, cyan, and black, are transferred onto the transfer surface of the transfer film 46. When the first color yellow is transferred, a subroutine SR1 is performed. When the last color black is transferred, a subroutine SR2 is performed. When the second color magenta or the third color cyan are transferred, a subroutine SR3 is performed.

In the process of the subroutine SR1, the control unit H sets a transfer start position of a first ink panel in the following manner: a center position in an ink ribbon conveyance direction of the first ink panel that is located in the first section of the ink ribbon 41 is put at a position which enables an entire transfer image to be placed within the first ink panel plane and which is closer to a rear end side (or the magenta side, which is part of the next ink panel) of the ink panel than the center of the first ink panel. In the present example, first, a transfer end position of the first ink panel (yellow) is set to the same position as a transfer end position that is used for an entire surface transfer process in which a transfer process is carried out across an entire surface of the transfer film 46; then, in accordance with data size of the transfer image, the transfer start position of the first ink panel is set. However, as for the transfer end position, a position a that is set in such a way as to move away from the transfer end position of the first ink panel toward the inner side is actually used as a transfer end position. As a result, the color of the ink panel does not overlap with a color of the subsequent ink panel, ensuring that the color of the ink panel is transferred to the transfer film.

Figure 6A:
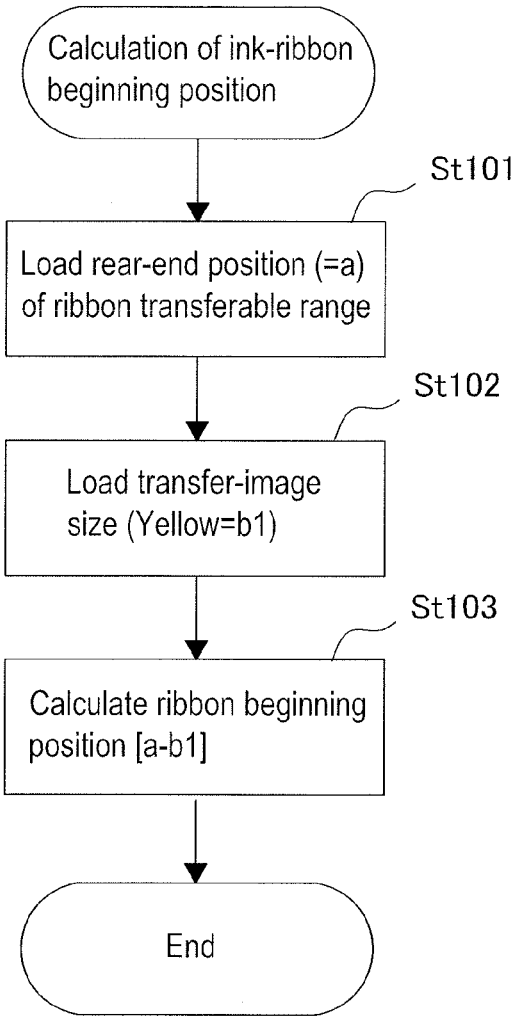
FIG. 6A is a flowchart illustrating a process of a subroutine SR1 by the control unit H.
Figure 6B:
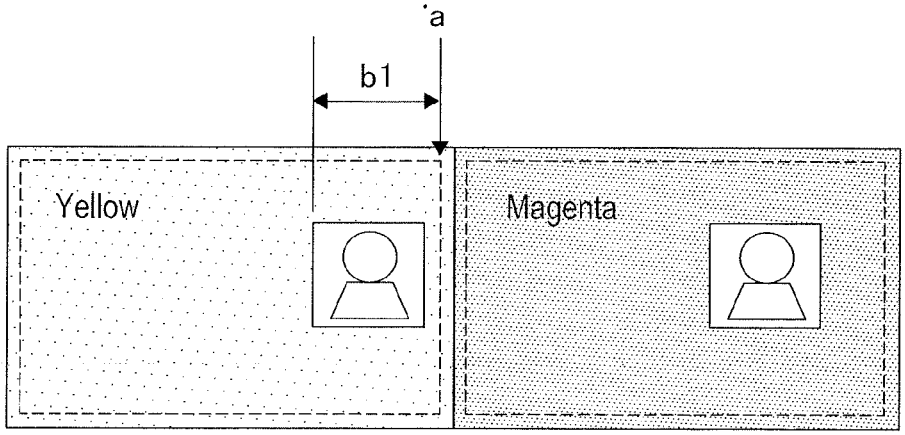
FIG. 6B is an explanatory diagram schematically illustrating a transfer start position of a first ink panel on an ink ribbon.

A flowchart of FIG. 6A shows the process of the subroutine SR1. The control unit H at St101 loads a "rear end position a of a ribbon transferable range." Then, the control unit H sets a transfer start position of the first ink panel in accordance with data size of a transfer image. At this time, the control unit H loads a size b1 in a conveyance direction in which the yellow of the first ink panel is printed (St102). Then, the control unit H calculates, based on the position a and the size b1, a transfer start position (beginning position) of the first color's ink panel (St103). As a result, the position [a−b1], which is a distance of b1 away from the position a in a minus direction, is the beginning position.

In the subroutine SR1, the beginning position of the first ink panel is set to [a−b1]. Therefore, a transfer end position of the first ink panel becomes the same as the transfer end position (or position a that is closer to the inner side) for the entire surface transfer process. Accordingly, when the next second ink panel is conveyed to the beginning position, the conveying starts from a-rear end of a portion to which an image has been transferred by the first ink panel. As a result, the time required to move the second ink panel to the beginning can be shortened.

According to the above order, the subroutine SR3 for the second color magenta and the third color cyan is performed. However, for ease of explanation, the process of the subroutine SR2 for the last color black will be described first.

In the process of the subroutine SR2, the control unit H sets a transfer start position of the last ink panel of the ink ribbon 41 in the following manner: a center position in an ink ribbon conveyance direction of a transfer image transferred by the last ink panel that is located in the last section of the ink ribbon 41 is put at a position which is closer to a tip side (or the cyan side, which is part of the previous ink panel) of the ink panel than the center position of the last ink panel. In the present example, a transfer start position of the last ink panel is set to the same position as a transfer start position for an entire surface transfer process in which a transfer process is carried out across an entire surface of a predetermined width corresponding to a printing width of the transfer film 46. However, as for the transfer start position, as shown in FIG. 7B, a position a' that is set in such a way as to move away from the transfer end position toward the inner side is actually used as a ribbon transfer start position.

Figure 7A:
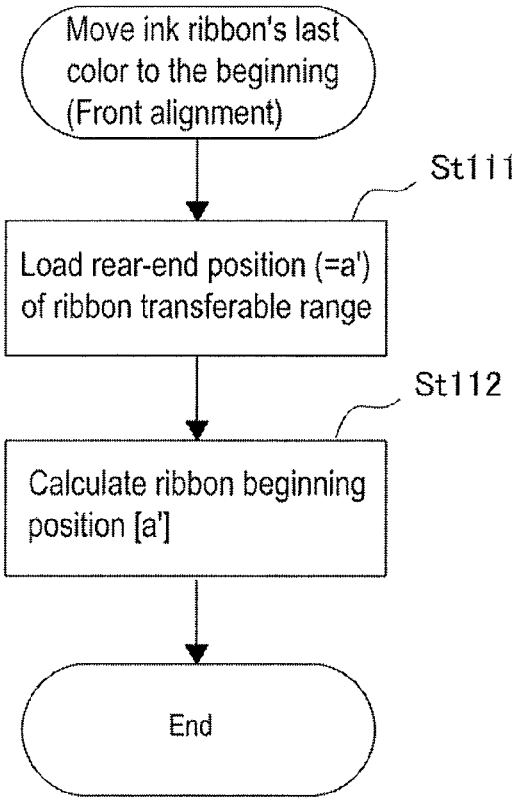
FIG. 7A is a flowchart illustrating a process of a subroutine SR2 by the control unit H.
Figure 7B:
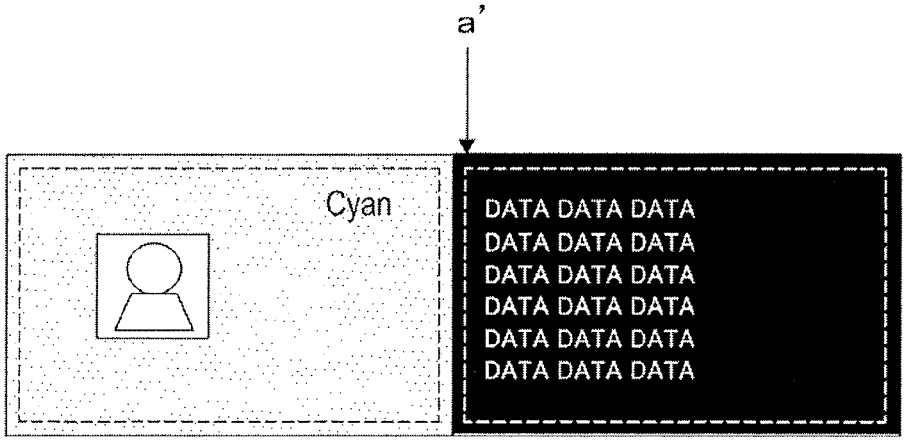
FIG. 7B is an explanatory diagram schematically illustrating a transfer start position of a last ink panel on an ink ribbon.

A flowchart of FIG. 7A shows the process of the subroutine SR2. The control unit H at St111 loads a "tip position a' of a ribbon transferable range." The control unit H uses the position a' as a beginning position [a'] (St112).

In the subroutine SR2, the beginning position of the last ink panel is set to [a']. Therefore, a beginning position of the last ink panel is the same as the tip position (or position a' that is closer to the inner side). Accordingly, when the last ink panel is conveyed to the beginning position, the conveying starts from a rear end of a portion to which an image has been transferred by the previous ink panel (cyan), and the ink panel is conveyed to the position a'. As a result, the time required to move the last ink panel to the beginning can be shortened.

The following describes the process of the subroutine SR3 for the second color that comes between yellow and black.

If the positions [a−b1] and [a'] are determined to realize the shortest times to move the first and last ink panels to the beginning positions, one or a plurality of transfer start positions of transfer images in the other magenta and cyan intermediate ink panels can be set at regular intervals between the transfer end position of the first ink panel and the transfer start position of the last ink panel. Since transfer data of the intermediate ink panels are set at regular intervals, the time required to move each ink panel to a beginning position can be shortened.

Figure 8A:
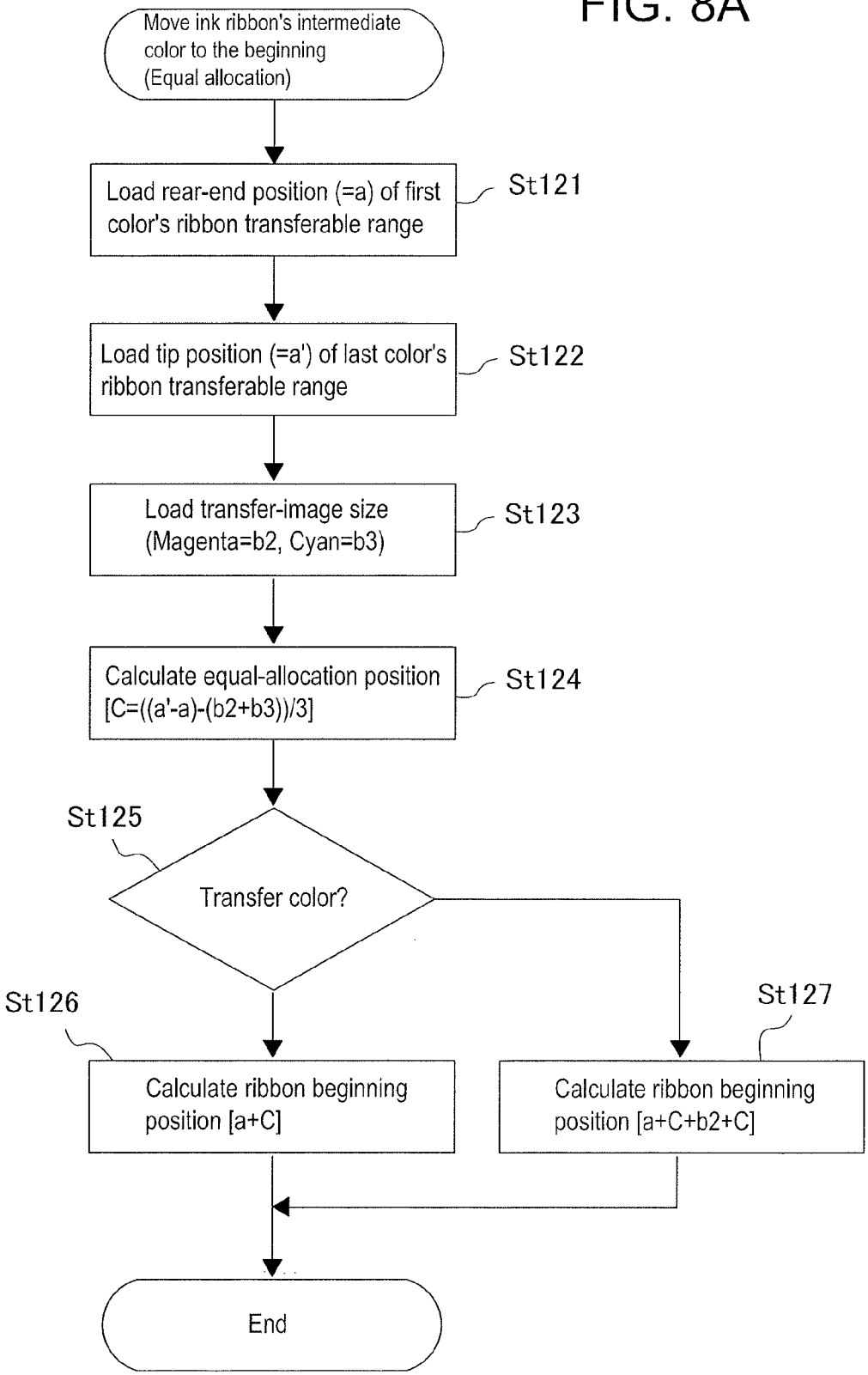
FIG. 8A is a flowchart illustrating a process of a subroutine SR3 by the control unit H.

A flowchart of FIG. 8A shows the process of the subroutine SR3. The control unit H loads a "rear end position a of a ribbon transferable range" for the first color yellow (St121), and loads a "tip position a' of a ribbon transferable range" for the last color black (St122). Then, the control unit H loads a size b2 in a conveyance direction in which the second color magenta is printed from the image data, and a size b3 in a conveyance direction in which the third color cyan is printed (St123). Then, the control unit H makes a calculation using the loaded data, and evenly allocates the beginning positions of the two colors (St124).

Figure 8B:
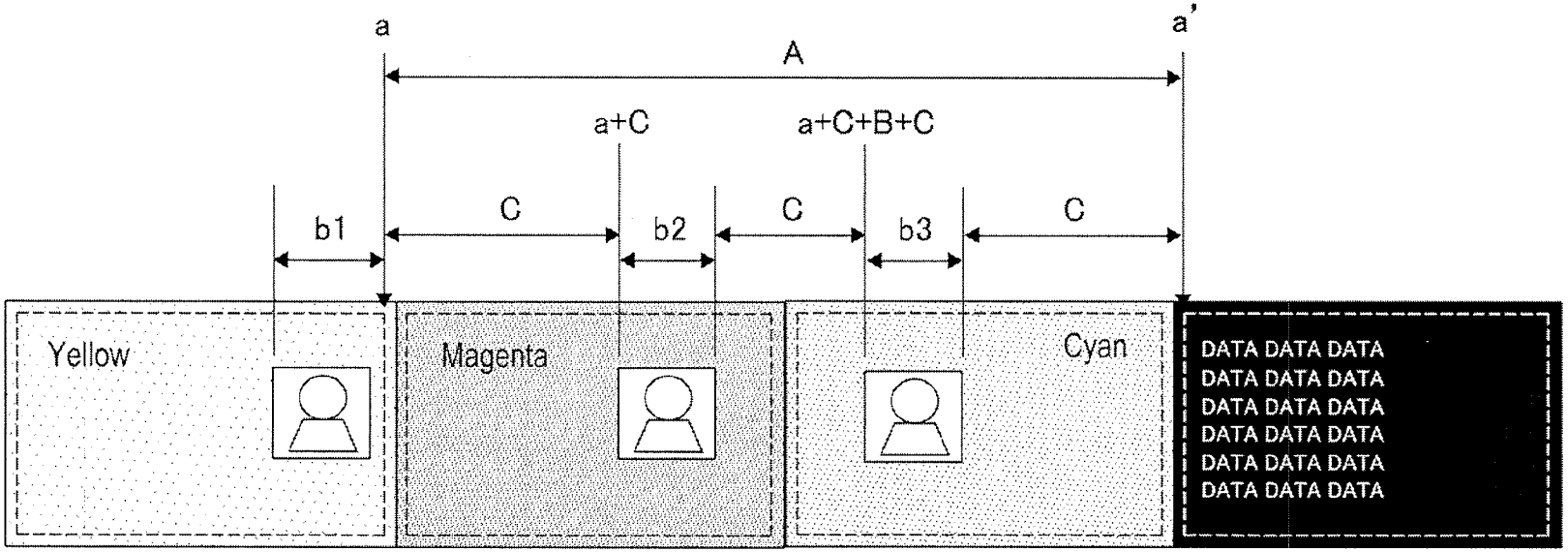
FIG. 8B is an explanatory diagram schematically illustrating a transfer start position of an intermediate ink panel on an ink ribbon in a process of FIG. 8A.

The process of evenly allocating is performed in the following manner: As shown in FIG. 8B, the distance A from the position a to the position a' is calculated, and the total distance B (=b2+b3), which is calculated from the data sizes of images printed in magenta and cyan, is subtracted from the distance A, and the resultant distance is equally divided to obtain an equal conveyance distance C. Therefore, it is possible to allocate an equal distance for conveying the ink ribbon when an ink panel of each color is moved to a beginning position. The process can be expressed by the following formula: ((a'−a)−(b2+b3))/3. The reason why the "((a'−a)−(b2+b3))" is divided by 3 is that the last black ink panel is included in the divisor as the ink panel, too, is moved to the beginning position a'.

After defining the equal conveyance distances to move the ink panels to the beginning positions, the control unit H calculates a beginning position of each ink panel depending on each of the colors, magenta and cyan (St125). In the case of magenta, the distance [a+C], which is the equal conveyance distance C away from the position a, is used as a beginning position (St126). In the case of cyan, the position [a+C+b2+C], which is the distance b2 plus the equal conveyance distance C away from the magenta's beginning position [a+C], is used as a beginning position (St127).

Figure 9:
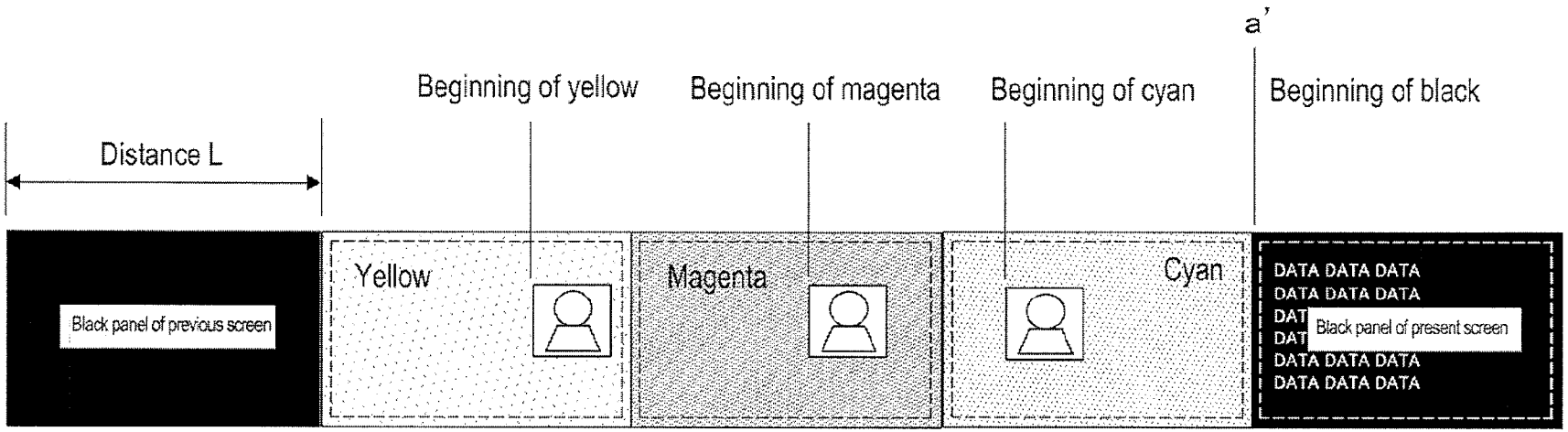
FIG. 9 is an explanatory diagram schematically illustrating a transfer start position of each ink panel.
Figure 10A:
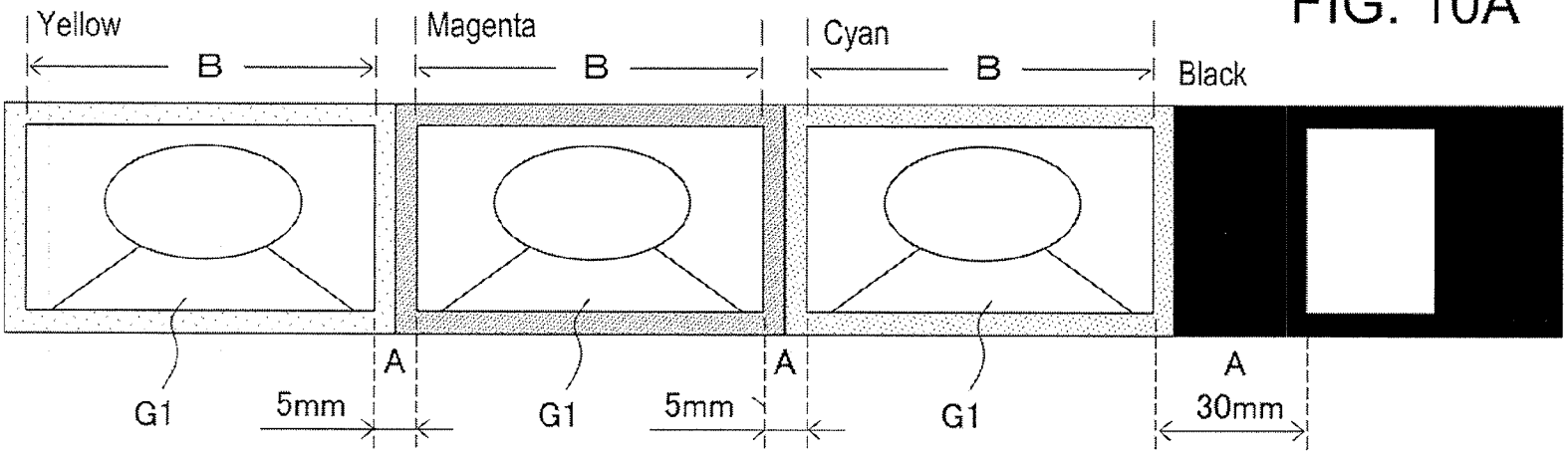
FIGS. 10A and 10B are explanatory diagrams schematically illustrating a conventional positioning control operation of each ink panel of an ink ribbon.
Figure 10B:
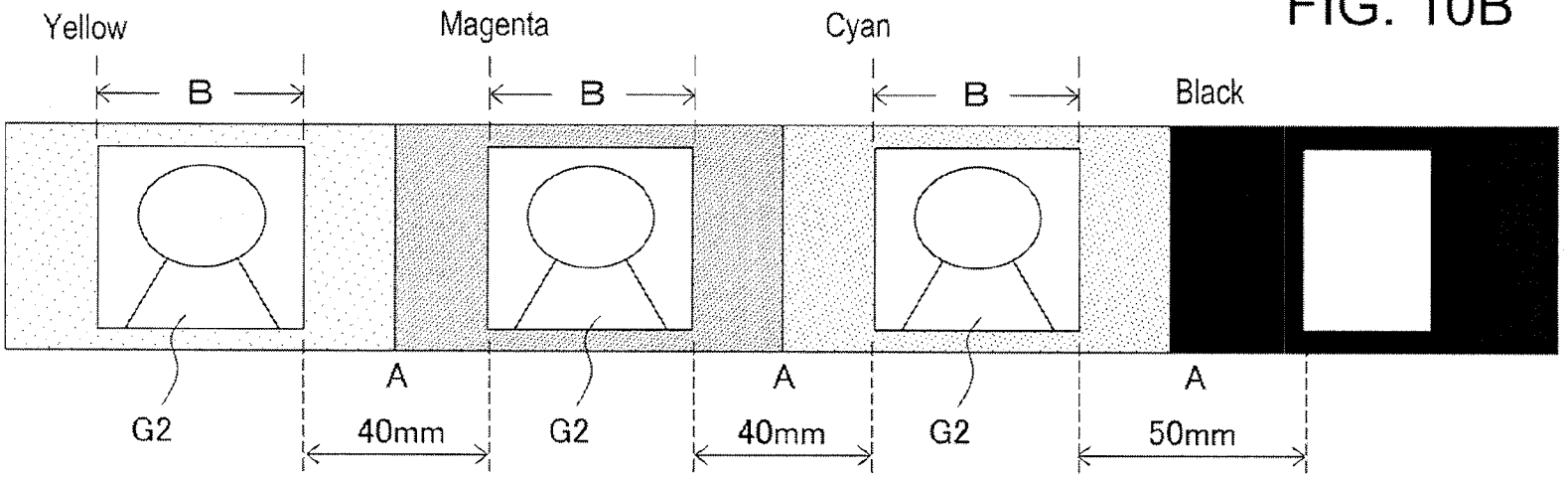

As shown in FIG. 9, the beginning positions of ink panels that are set as described are different. Each time a different print color is used, there is no need to move over a distance L that is equivalent to a long side of each ink panel, making the distance each ink panel is conveyed the shortest. Therefore, during the printing, the total time required to convey the ink ribbon 41 can be shortened.

Figure 4:
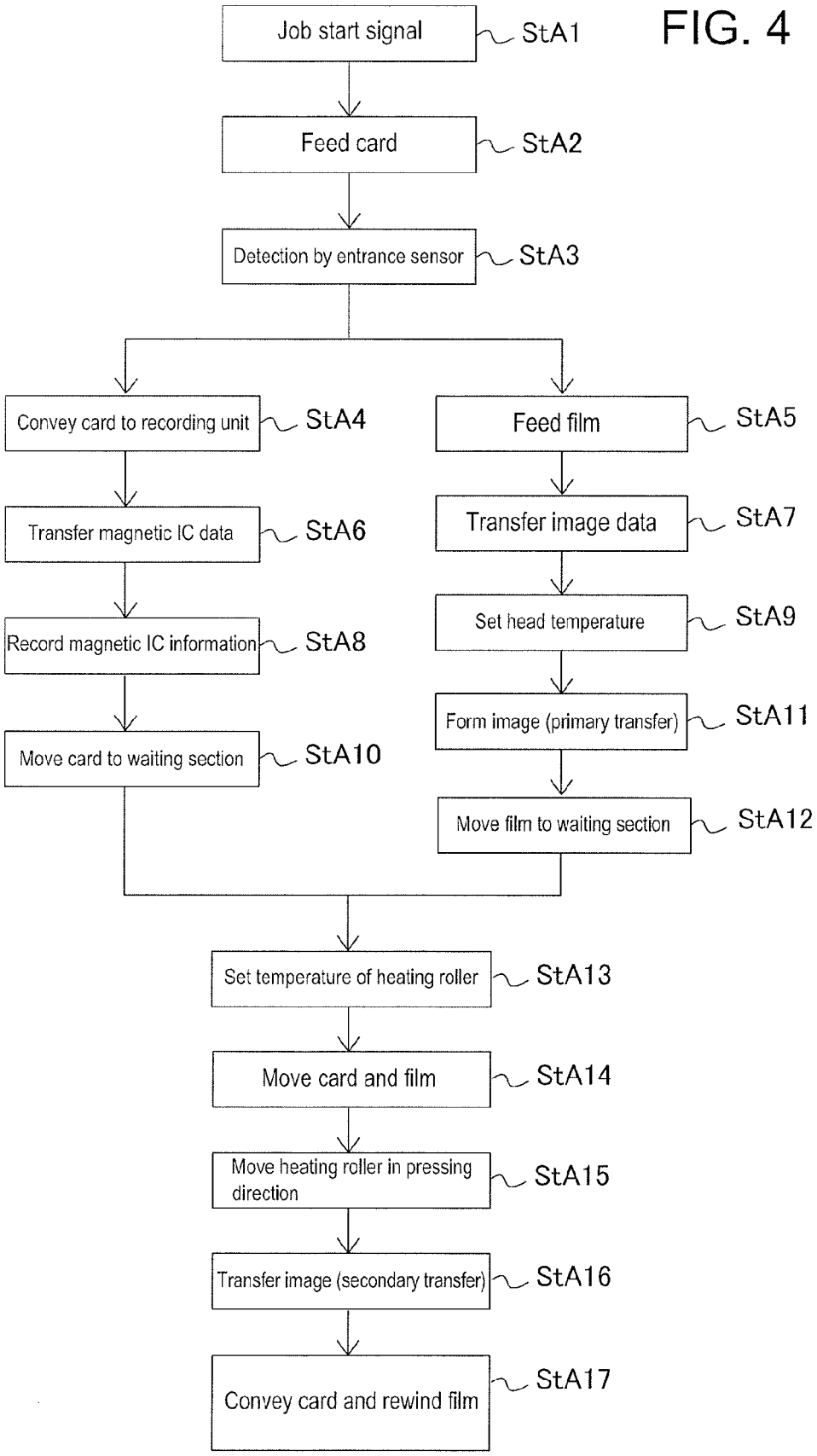
FIG. 4 is a flowchart illustrating a control operation of a control unit H in the control configuration of FIG. 3.

Returning to the flowchart of FIG. 4, in the process of forming an image at StA11, the control unit H, as described above, takes the transfer film 46 from the supply spool 47, and moves the transfer film 46 to an image-transfer beginning position as the transport roller 49 is rotated in a clockwise direction. At this time, as for the ink ribbon 41, the control unit H controls a process of driving the winding motor Mr1 and rotates the take-up spool 44 in a counterclockwise direction in such a way that the position [a−b1] of the yellow ink panel becomes the beginning position, and that the position moves only a distance of (L−b1) from a rear end of the black ink panel that is used for the previous printing process. As a result, the transfer film 46 is aligned with the ink ribbon 41 at the beginning position.

Then, after the transfer film 46 is aligned with the ink ribbon 41 at the beginning position, the control unit H drives an extrusion mechanism (not shown) to move the image formation platen 45 toward the thermal head 40; the image formation platen 45 therefore comes in contact with the thermal head 40 in such a way that the transfer film 46 and the ink ribbon 41 are sandwiched therebetween. At the same time, the control unit H controls a process of rotating the transport roller 49 in a counterclockwise direction (or a direction indicated by dotted arrow), as well as a process of driving the winding motor Mr1 to control a process of rotating the take-up spool 44 in a counterclockwise direction. As a result, the transfer film 46 and the ink ribbon 41 move a distance equivalent to a predetermined width corresponding to a printing width of the transfer film 46. When the transfer film 46 and the ink ribbon 41 are moving, an image is transferred onto the transfer film 46 in yellow by the first ink panel of the ink ribbon 41.

After the process by the yellow ink panel of transferring the image is completed, the control unit H controls the transport roller 49 in such a way that the transport roller 49 rotates in a clockwise direction again, thereby moving the transfer film 46 back to the beginning position as the transfer film 46 moves a distance equivalent to a printing width of one card. Then, the control unit H controls a process of driving the winding motor Mr1 in such a way that the ink ribbon 41 moves only the equal conveyance distance C. As a result, the next magenta ink panel is aligned with the transfer film 46 at the beginning position.

After the alignment is carried out in the same way as for the yellow, the control unit H uses the image formation platen 45 and the thermal head 40 in such a way that the transfer film 46 and the ink ribbon 41 are held therebetween, and moves the transfer film 46 and the ink ribbon 41 toward the take-up spool 44 by a distance equivalent to a predetermined width corresponding to a printing width of a card. In this manner, an image is transferred in magenta.

Then, for the next cyan and black, the control unit H similarly carries out alignment at the beginning position by rewinding the transfer film 46 and moving the ink ribbon 41 by the equal conveyance distance C; the control unit H moves the transfer film 46 and the ink ribbon 41 toward the take-up spool 44 by a distance equivalent to a predetermined width corresponding to a printing width of a card. In this manner, thermal transfer is carried out. As a result, on the same portion of the transfer film 46 that corresponds to a printing width of a card, the thermal transfer is repeated in four colors, thereby forming an image.

After the image is formed on the transfer film 46, the control unit H moves the transfer film 46 to the film waiting section F (StA12). The process of moving the film is carried out by rotating the feeding motor Mr2 and the take-up motor Mr3, and detecting a marker. In this state, the card is waiting at a beginning position in the media waiting section E (StA10), and the transfer film 46 at a beginning position in the film waiting section F. Since the card and the film are at the beginning positions, it is possible to reduce a positional difference therebetween as both are simultaneously sent from the above positions to the image transfer unit B at the same speed.

Then, when the card and the transfer film 46 are waiting in the waiting sections E and F, the control unit H makes a determination as to whether or not the temperature of the heating roller 33 is an appropriate value (StA13). If the card or the transfer film 46 is not prepared in the waiting sections E or F (i.e. when the card or the transfer film 46 does not reach the waiting sections E or F), and when the heating roller 33 is not at an appropriate value, the control unit H waits until each condition is satisfied.

Then, when the heating roller 33 has reached an appropriate temperature, the control unit H feeds the card and the transfer film 46 to the image transfer unit B from the waiting sections E and F. The process of feeding the card and the transfer film 46 is carried out at the same timing and at the same speed; the process is so controlled that both reach the image transfer unit B at the same time (StA14). At a time when the card and the film have reached the transfer platen 31, the control unit H lifts the heating roller 33 that is located at a waiting position, which is away from the platen, to a position where the heating roller 33 is pressed against the platen (St15); this state is shown in FIG. 3 as a waiting state, and as a transfer state in FIG. 5.

In the state shown in FIG. 5, as the tip of the card and the transfer film 46 are moved at the same time, an image of the transfer film is bonded and transferred to the card in a thermal compression manner (Secondary transfer; StA16). Then, the control unit H controls a process of conveying the card to the storage stacker 60, and a post-transfer process of winding the transfer film 46 around the take-up spool 48 (StA17). The control unit H controls a process of driving the take-up motor Mr3 to control the process of winding the transfer film 46.

As described above, in the transfer device of the embodiment of the present invention, on the ink ribbon, the beginning positions where the ink panels of the yellow, magenta, cyan, and black are aligned with the transfer film 46 are different. Therefore, compared with a conventional technique by which each ink panel is conveyed in such a way as to sequentially overlap with respect to a plane of a transfer film to which an image is transferred, the transfer/print speed can be increased as the conveyance time for the ink ribbon is reduced.

Incidentally, according to the present embodiment, what is shown is that the conveyance directions of the transfer film 46 and ink ribbon 41 are opposite in the cue operation. However, the transfer film 46 may be once conveyed to a position that is closer to a transfer film conveyance-direction upstream side of the transfer process than the thermal head 40; the transfer film 46 then may be conveyed in the same direction as the conveyance direction of the ink ribbon 41, and be moved to the beginning position. In this case, when a process of transferring an image starts after a process of conveying to a beginning position, it is possible to reduce effects of backlash associated with a drive motor for conveying the transfer film 46, or the like.

Figure 11:
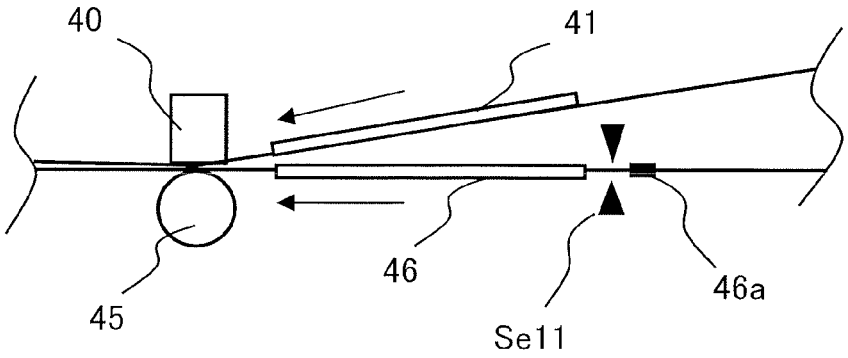
FIG. 11 is an explanatory diagram schematically illustrating an image formation unit of another embodiment to which the present invention can be applied.

According to the present embodiment, what is disclosed is the configuration in which a transfer start position is the same as a beginning position. However, the beginning position may be set closer to a transfer film conveyance-direction upstream side of the transfer process than the thermal head 40 (See FIG. 11). In this case, in the situation where the transfer start positions of the transfer film 46 and ink ribbon 41 are located closer to the upstream side than the thermal head 40, the transfer film 46 and the ink ribbon 41 are held between the thermal head 40 and the image formation platen 45; in this state, the transport roller 49 and the take-up spool 44 are rotated.

At this time, a mark 46*a* that is formed on the transfer film 46 is detected by a sensor Se11. At a time when the transfer start positions of the transfer film 46 and ink ribbon 41 have reached right below the thermal head 40, the thermal head 40 is driven to start the transfer.

Accordingly, after the process of moving to the beginning, the traveling paths of the transfer film 46 and ink ribbon 41 do not change. Furthermore, during the transfer operation, the transfer film 46 and the ink ribbon 41 are conveyed at a constant speed, contributing to an improvement in transfer quality.

Incidentally, according to the present embodiment, what is shown is an intermediate transfer-type printer that uses the intermediate transfer film 46. However, the present invention also can be applied to a printer of a direct type that transfers directly to recording media such as cards.

Moreover, a transfer start position of the first color ink panel (yellow) is shifted toward the next ink panel (magenta). Therefore, it takes time to move the first color ink panel to the beginning position. However, for example, in the case of the transfer film 46, the conveyance distance from the position where secondary transfer is finished to the primary-transfer beginning position is long; during that time, the first color ink panel can be moved to the beginning position. Therefore, there is no problem. Moreover, even in the case of the direct type, during a period of time when a card is supplied from a supply unit to a transfer unit, the first color ink panel can be moved to a beginning position. Therefore, there is no problem.

Incidentally, the ink panels of the ink ribbon of the present embodiment are yellow, magenta, cyan, and black. However, the order that the ink panels are arranged can be appropriately changed. A plurality of black panels may be provided. Panels, such as a heat seal panel, peel-off panel, UV panel, and overcoat panel, may be used in combination. The above panels not containing ink, too, are among the panels of the ink ribbon; the panels are therefore defined as ink panels.

The present invention relates to a technique for increasing a speed associated with a transfer/print time of a device that transfers and prints characters and color images onto card-like recording media such as ID cards, identification papers, and various membership cards. The present invention has industrial applicability.

Incidentally, the present application claims priority from Japanese Patent Application No. 2012-170338, the contents of which is incorporated herein by reference.

What is claimed is:

1. A transfer device that uses an ink ribbon on which a plurality of types of ink panel planes of a predetermined width corresponding to a printing width of a recording medium are disposed in a frame sequential manner to transfer and print a transfer image, such as a character and an image, onto the recording medium, comprising:

an image formation unit that conveys the ink ribbon and recording medium being held between a thermal head and a platen, and transfers the transfer image onto the recording medium;

ink ribbon conveyance means for conveying the ink ribbon;

recording medium conveyance means for conveying the recording medium; and control means for controlling the ink ribbon conveyance means and the recording medium conveyance means to control, in the image formation unit, beginning positions of a transfer start position of the ink panel and a transfer start position of the recording medium, wherein in controlling the beginning positions, the control means sets a transfer start position of a first ink panel in such a way that a center position in an ink ribbon conveyance direction of the transfer image transferred by the first ink panel that is located in a first section of the ink ribbon is put at a position which enables the entire transfer image to be placed within the first ink panel plane and which is closer to a next ink panel's side than a center of the first ink panel.

2. The transfer device according to claim 1, wherein the control means sets a transfer start position of a last ink panel of the ink ribbon in such a way that a center position in an ink ribbon conveyance direction of the transfer image transferred by the last ink panel that is located in a last section of the ink ribbon is put at a position which is closer to a previous ink panel's side than a center position of the last ink panel.

3. The transfer device according to claim 2, wherein the control means sets one or a plurality of transfer start positions of a transfer image in another intermediate ink panel disposed between the first ink panel and the last ink panel in such a way that the transfer start positions are set at regular intervals between a transfer end position of the first ink panel and a transfer start position of the last ink panel.

4. The transfer device according to claim 3, wherein if a distance from a transfer end position of the transfer image on the first ink panel to a transfer start position of the last ink panel is represented by A, the number of the intermediate ink panels by N (including 1), a total distance associated with a data size of a transfer image in the ink ribbon conveyance direction of transfer data transferred by the intermediate ink panel by B, and a distance from a transfer end position of a previous ink panel to a transfer start position of a next ink panel by C, the control means sets a transfer start position of the intermediate ink panel on the basis of C that is calculated by: $C=(A-B)/(N+1)$.

5. The transfer device according to claim 2, wherein the control means sets a transfer start position of the last ink panel to the same position as a transfer start position used for an entire surface transfer process in which a transfer process is carried out across an entire surface of the recording medium.

6. The transfer device according to claim 1, wherein the control means at first sets a transfer end position of the first ink panel to the same position as a transfer end position used for an entire surface transfer process in which a transfer process is carried out across an entire surface of the recording medium, and then sets a transfer start position of the first ink panel in accordance with a data size of a transfer image.

* * * * *